United States Patent [19]

Murray

[11] Patent Number: 4,694,600

[45] Date of Patent: Sep. 22, 1987

[54] INDICIA DISPLAY MODULE USING LIGHT PIPE

[75] Inventor: Ledell L. Murray, Noblesville, Ind.

[73] Assignee: General Indicator Corporation, Pardeeville, Wis.

[21] Appl. No.: 423,692

[22] Filed: Sep. 27, 1982

[51] Int. Cl.[4] ..... G09F 11/18

[52] U.S. Cl. ..... 40/518; 40/10 R; 40/5; 40/546

[58] Field of Search ..... 40/5, 518, 546, 10

[56] References Cited

U.S. PATENT DOCUMENTS

| | | | |
|---|---|---|---|
| 2,448,244 | 8/1948 | Arnold | 40/546 |
| 2,646,637 | 7/1953 | Nierenberger et al. | 40/546 |
| 3,159,937 | 12/1964 | Barnes | 40/5 |
| 3,514,882 | 6/1970 | Avery | 40/546 |
| 4,258,490 | 3/1981 | Trame | 40/518 |
| 4,337,588 | 7/1982 | Clapper | 40/518 |

*Primary Examiner*—Gene Mancene
*Assistant Examiner*—Wenceslao J. Contreras
*Attorney, Agent, or Firm*—Bayard H. Michael

[57] ABSTRACT

The price display module has a clear plastic light pipe and support member mounted on the back of a bezel to display an indicia on the pre-coiled strip through the bezel aperture and illuminated by light piped through the member from the back light source to the front of the member. The coiled ends of the strip are supported by and separated by the pipe so the illumination of the displayed indicia is uniform.

3 Claims, 4 Drawing Figures

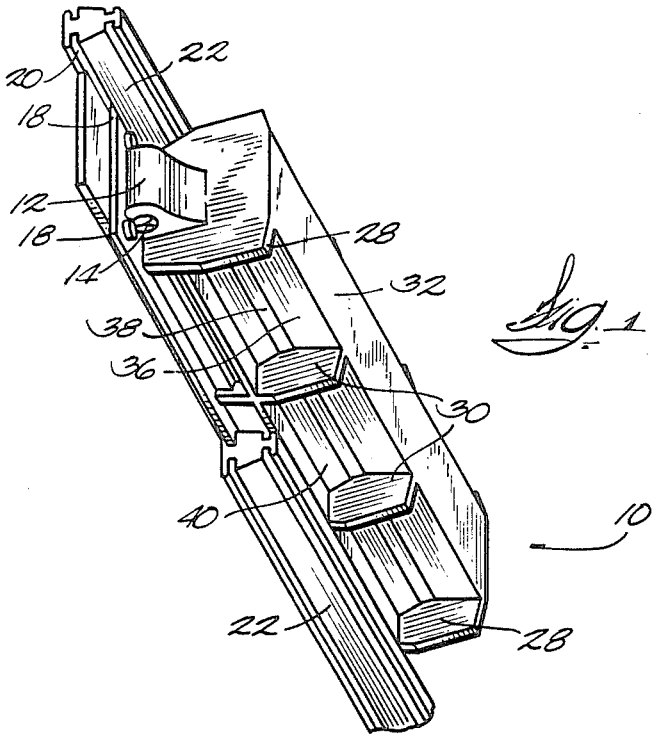
Fig. 1
Fig. 2
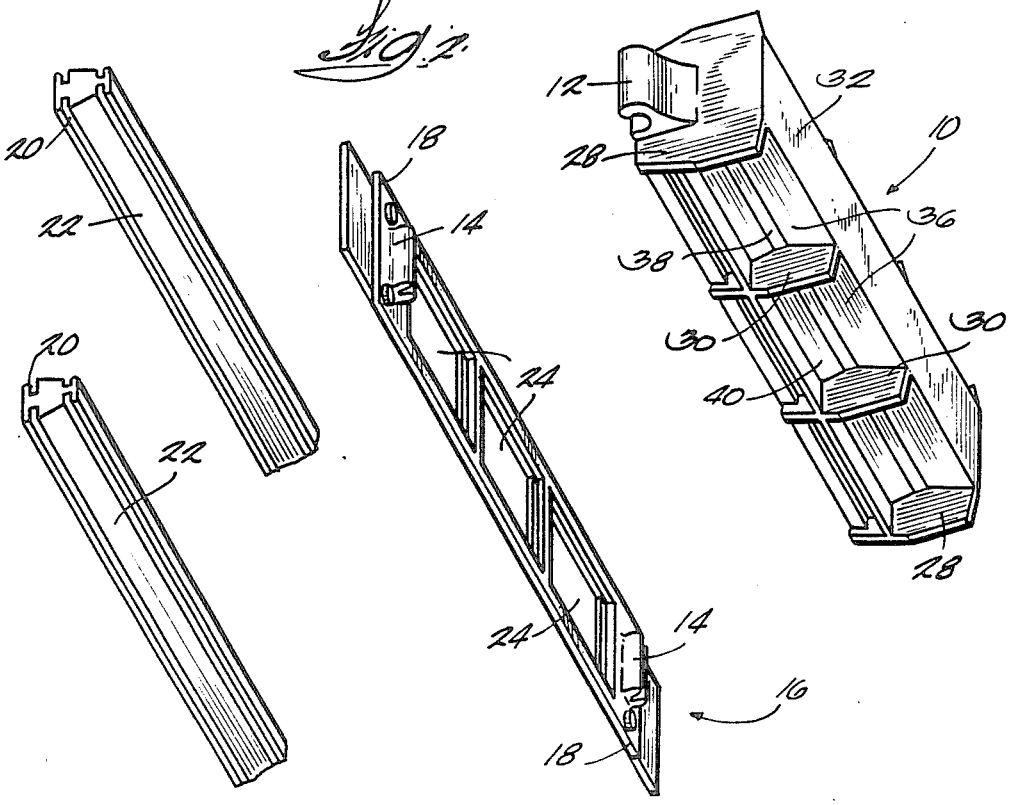

INDICIA DISPLAY MODULE USING LIGHT PIPE

BACKGROUND OF THE INVENTION

Fast food stores typically display the names of food items and prices on signs which are provided with back lighting. The prices are displayed on modules permitting changing the price. Typically, the numbers are on pre-coiled price strips which are supported so that when one of the numbers is displayed at an aperture in a bezel, the coils at each end of the strip are theoretically spread apart behind the displayed number to permit light to enter from the light source. In practice, however, those coils tend to close behind the displayed number and cast shadows on the number. Thus, the lighting is not uniform and the displayed numbers are darker than desirable.

A further problem encountered with pre-coiled price strips is that the nature of the strip dictates that the larger of coils tends to take up the smaller coil, i.e. when the displayed number is not exactly in the middle of the strip, the larger coil will exert a greater force than the force exerted by the smaller of the two coils. Therefore, the displayed number tends to migrate towards the larger coil and change the displayed price. This tendency increases as the sign is subjected to vibration by wind, ventilating fans, etc.

SUMMARY OF THE INVENTION

The principal object of this invention is to provide means for illuminating a back lighted coiled display strip without shadows. This is done by supporting the strip on a molded plastic block which functions as a light pipe to gather light from behind and pipe it to the front to be emitted through the tape providing shadow free, uniform, bright illumination of the tape. The light is piped to the front between the coils of the strip so there can be no shadows.

The forward portion of the light pipe is provided with an angle complementary to the bevel of the support rails of the sign frame. There is a relatively small clearance between the light pipe and the beveled surface. The curl of the strip will cause the strip to rub against the bevel. This imposes a slight frictional resistance to movement to prevent the tape from migrating when the frame is subjected to vibration by reason of wind or machinery, such as ventilating fans.

The nature of the support rails and the light pipe are such that the space between the principal surface of the light pipe and the beveled rail present a converging space. The pipe has a blocking member preventing the coils from entering the converging space where it could wedge.

BRIEF DESCRIPTION OF THE DRAWINGS

FIG. 1 is a perspective view, somewhat in schematic form in that the rails in which the bezel is mounted are shown only in part.

FIG. 2 is an exploded view of the parts shown in FIG. 1.

DETAILED DESCRIPTION OF THE DRAWINGS

Figure 3:
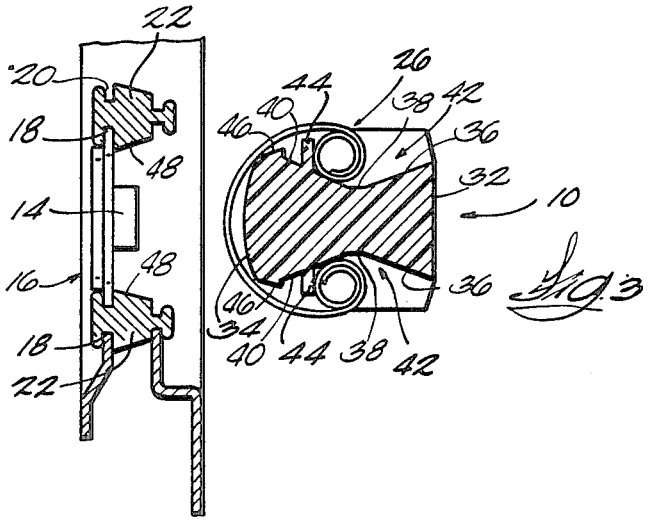
FIG. 3 is a cross section through the plastic light pipe with a coiled price strip in place but prior to mounting in the bezel.
Figure 4:
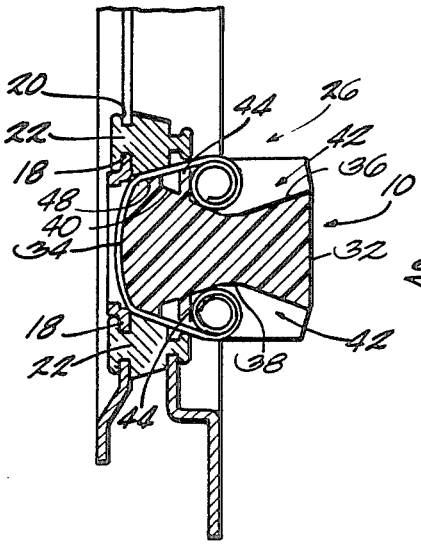
FIG. 4 is a cross-sectional view showing the manner in which the assembly imposes a friction load on the price strip when the plastic module is mounted on the bezel.

The clear plastic block 10 is provided with bracket 12 at each end having a groove adapted to snap over the splayed fitting 14 on the back side of the opaque bezel 16 which has longitudinal edges 18 which are adapted to slide into grooves 20, 20 in the mounting rails 22 which are part of the support frame. When so mounted the front of the bezel is in front of the edges 18. The bezel has three apertures 24 through which the price indicia on the individual precoiled price strips 26 may be seen. The clear plastic block 10 has three sections each of which is to contain a suitable price strip with the end dividers 28 and the medial dividers 20 serving to confine the coils.

The important aspect of the clear plastic block resides in the fact that it has a special configuration to function as a light pipe. Light entering the back surface 32 is, for all practical purposes, captured in the clear plastic and will be reflected on the internal flat surfaces until it reaches the front surface 34 of the block where the light will escape and travel through the price strip to illuminate the indicia. The angles of the converging sides 36, 36 leading to the short parallel sides 38, 38 and the diverging sides 40, 40 are selected to keep the light reflecting within the clear plastic. Diverging sides 40 lead to the short converging sides 46 which keep the light in the pipe while cooperating with the beveled sides 48 of the rails 22 to provide reduced clearance for the tape so the curl of the tape will cause friction against the beveled rail holding the tape in place. The light is almost collimated when it reaches the front surface, even though it starts out as highly diffused light coming from a fluorescent tube preferably mounted on an axis transverse the axis of the light pipe 10. Experimental blocks made with curved sides instead of the flat sides did not give satisfactory results. The light was not even across the display.

The converging/diverging sides provide cavities or pockets 42 receiving the coils within the general space between the mid-lines of the support rails. This means the coils of one module will not interfere with the coils of a vertically adjacent module. The angles of the sides are reflected to avoid internal incident light angles which will allow the light to escape from the sides...i.e. the angles insure the light pipe will pipe the light. Substantially any clear plastic will function properly as a light pipe. Acrylic is excellent. The principles involved are similar to those involved in fiberoptics. The output from the front surface 34 can be increased slightly by etching the surface but the increase does not seem to justify the extra cost.

The position of the coil 26 in the pocket 42 resting on or behind the shelf 44 keeps the coil out of the converging space where it could jam. Since the light is piped between the coils, the coils cannot cause a shadow to appear on the indicia display and degrade the quality of the display. This overcomes a great disadvantage with the prior art which frequently displayed a degraded image due to shadows caused by the coils of the price tape.

In effect, the light pipe gathers light at the rear surface and pipes it to the front surface for emission through the price tape while keeping the coils of the price tape out of the light path. Indeed, there is no way for the coils to get into the light path, the light path being inside the solid structure supporting the coils. The friction obtained with this design so stabilizes the tape that it may be difficult to move. Therefore, the pores of the plastic tape are filled with zinc stearate to make the tape feed easier.

I claim:

1. A display module comprising, a bezel having an aperture therein, a clear plastic light pipe mounted on the back of the bezel and having a rearwardly facing surface which accepts light, said light pipe having opposed sides which converge and then diverge going from the rear to the front of the module, said light pipe having a generally flat front surface through which light is emitted, the light entering the rear surface being internally reflected forward to the front surface, a coiled generally opaque indicia strip having translucent or transparent indicia thereon, the coiled ends of the strip being supported in the cavities on opposing sides of the light pipe which cavities are formed by the converging and diverging sides whereby the strip extends across the front of the module between the light pipe and the bezel and selected indicia on the strip are displayed at the aperture.

2. A display module according to claim 1 mounted in a frame having parallel support rails, said bezel being mounted in grooves in said rails, each of the rails including a beveled surface closely adjacent to the light pipe, said pipe including surfaces parallel to said beveled surfaces whereby the natural curl in the indicia strip causes the strip to frictionally engage the beveled surface.

3. A display module according to claim 2 in which each of the cavities are provided with a protrusion preventing the coil from becoming trapped in the converging space.

* * * * *